US005803401A

United States Patent [19]

Matsuzoe

[11] Patent Number: 5,803,401

[45] Date of Patent: Sep. 8, 1998

[54] REEL FOR TRANSPORTING ELONGATE ARTICLES

[75] Inventor: Noriho Matsuzoe, Nishinomiya, Japan

[73] Assignee: Robert Bosch, GmbH, Stuttgart, Germany

[21] Appl. No.: 838,386

[22] Filed: Apr. 8, 1997

[30] Foreign Application Priority Data

Nov. 26, 1996 [JP] Japan ..... 8-331616

[51] Int. Cl.[6] ..... B65H 75/22

[52] U.S. Cl. ..... 242/608.5

[58] Field of Search ..... 242/608.5, 608.6, 242/118.6, 118.61, 118.7, 118.8

[56] References Cited

U.S. PATENT DOCUMENTS

| | | | |
|---|---|---|---|
| 2,312,899 | 3/1943 | Hamburger | 242/608.5 |
| 3,239,159 | 3/1966 | Cohen | 242/608.5 |
| 5,524,850 | 6/1996 | Liao | 242/608.5 |
| 5,593,108 | 1/1997 | Eck et al. | 242/608.5 |

FOREIGN PATENT DOCUMENTS

| | | | |
|---|---|---|---|
| 2193380 | 7/1990 | Japan | 242/608.5 |

*Primary Examiner*—John M. Jillions

*Attorney, Agent, or Firm*—Edwin E. Greigg; Ronald E. Greigg

[57] ABSTRACT

A reel for transporting elongate articles has a pair of discs (2) connected to each other by a hub (3) disposed between the discs. L-shaped hooks (8) are formed integral with the hub, and their heads protrude from each of its open ends to engage with slots formed in each disc. Bodies **(9*a*) of resilient pawls (9) for each disc extend from the outer periphery of the hub's internal cylinder (5). Each pawl (9) has a locking end located near and inside the hub's external cylinder (4) at each open end, and the end can rock in axial direction. Stoppers (9A) protruding from the external cylinder are located adjacent to the locking ends so as to inhibit them from rocking in an undesired circular direction. Slots (10) and apertures (11) formed in each disc engage with the hooks (8) and pawls (9)**, respectively, so that the reel can be assembled and disassembled easily and readily, ensuring a reliable engagement of the discs with the hub during repeated use.

2 Claims, 7 Drawing Sheets

REEL FOR TRANSPORTING ELONGATE ARTICLES

BACKGROUND OF THE INVENTION

1. Field of the Invention

The present invention relates to a reel for transporting elongate articles, wherein the reel is composed of a pair of discs connected one to another by a middle hub. The elongate articles such as flexible tapes, wires and chains will be wound up on the hub so as to be transported to a site where they are used. At the site, an axle will be inserted in a central bore of the hub so that the reel rotates to unwind the article therefrom.

2. Description of the Prior Art

The reels of this kind have widely been used to wind up thereon and unwind therefrom the elongate articles used in the industries. The size of and distance between each pair of the discs as well as the diameter of the hubs connecting them should match the varied dimension of those articles. Usually, empty reels from which the articles have been unwound are collected at the site and returned to the suppliers for the purpose of recycling or reuse.

Not only such emptied reels but also new ones from a reel maker have occupied within a cargo the same large space as they were loaded with the articles. Therefore, some proposals were made to enable the empty or new reels to be disassembled and reassembled to be shipped in sections.

FIG. 10 shows a reel of a certain collapsible type currently available. It comprises a plurality of arrow-shaped lugs 8A protruding from the end surfaces of a hub 3A. Small apertures 10A formed in discs 2A will engage with the lugs, forcing the long body portions thereof to temporarily rock against their resiliency in a manner as shown at the phantom lines 'c'. This structure relies only on the elastic recovery of said portions to keep the lugs in engagement with the apertures.

Those lugs have to be rocked again when it is desired to disengage the discs from the hub of an emptied reel. Further, resilient lugs 8A should act on the discs 2A and inhibit same from rotating relative to the hub 3A while the reel is operating. Thus, the effect of elastic recovery will early become weaker due to mechanical fatigue of those lugs. As a consequence, the assembled state is less firm and less reliable, making it difficult for those reels to be reused.

SUMMARY OF THE INVENTION

An object of the present invention made in view of the described problems is therefore to provide a reel for transporting elongate articles and of such a novel structure that it can be repeatedly assembled and disassembled easily and readily, without rendering less reliable the engagement of its discs with its hub during the repeated use of the reel.

The reel provided herein for transporting elongate articles comprises a pair of discs facing one another, a hub having opposite open ends and interposed between the discs to connect them one to another, the hub composed of an internal cylinder and an external cylinder surrounding the internal cylinder and extending coaxially therewith, hooks L-shaped in side elevation at their hooking heads and respectively having bodies continuing therefrom and secured to an inner periphery of the hub, the hooking heads extending beyond the open ends of the hub so as to protrude outwardly from an outer face of each disc, at least one resilient pawl secured in the hub and provided for each disc, the resilient pawl having a locking end located near and inside the external cylinder at one of the open ends of the hub so as to rock axially thereof, the resilient pawl further having a rockable body that in turn has an end formed integral with the locking end and another end directly or indirectly connected fixedly to the internal cylinder of the hub, at least one stopper formed integral with an inner peripheral portion of the external cylinder and located adjacent to the locking end so as to protect this locking end from rocking in a reverse circular direction, slots formed in each disc and capable of receiving, firmly engaging with and disengaging from the respective hooking heads, and at least one aperture also formed in each disc and capable of engaging with and disengaging from the locking end of the resilient pawl.

The rockable body that can rock in a space including the hub's open end may either be connected indirectly to the internal cylinder by and through an extension continuing from said body (as in a first, second and fourth embodiments described below). In this case, the extension may be formed as a part of a tie plate connecting the external cylinder to the internal one, with the part being separated except for its inner extremity from the remainder of the tie plate (as in the fourth embodiment). Alternatively, the rockable body may be connected directly to the internal cylinder (as in a third embodiment). In any case, such a rockable body may be located at any position axially of the hub, and may be of any cross-sectional shape, provided that a sufficient rigidity and elastic recovery are ensured. Thus, the resilient pawl having the locking end adjacent to the external cylinder will be able to rock axially of the hub, with a fulcrum therefor being located near the internal cylinder of said hub.

The hub having an axial bore for receiving a rotatable shaft may generally and preferably be composed of an internal cylinder and an external cylinder. The internal cylinder defines the axial bore and is rigidly connected by a tie plate to the external cylinder. The tie plate may not necessarily be displaced at a middle height of the hub, but at or close to the open end thereof.

It is desirable that the internal cylinder connected by the tie plate extends coaxially with the external cylinder to constitute the hub, and the hub as well as the discs are formed by the molding of a synthetic resin or synthetic resins.

DETAILED DESCRIPTION OF THE PREFERRED EMBODIMENTS

Figure 1:
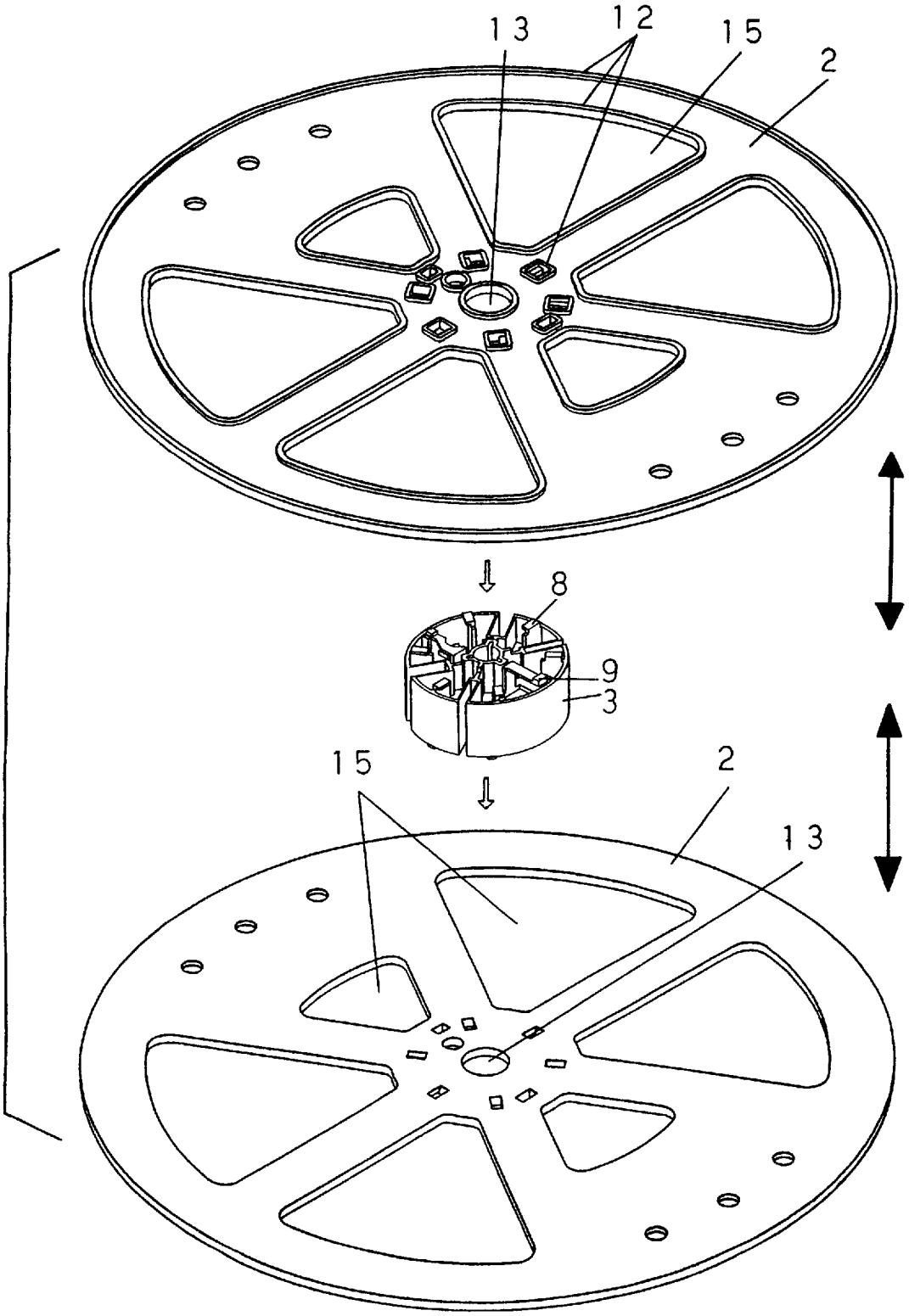
FIG. 1 is a perspective view of a reel composed of discs and a hub in a first embodiment and shown in a disassembled state.

A reel provided in embodiments of the present invention described below referring to the drawings is not intended for use with such articles as fishing lines or textile yarns but for use with other industrial elongate articles. The reel 1 comprises a pair of facing discs 2 firmly connected one to another by a hub 3 that serves as a core for winding up an elongate article.

In a first embodiment shown in FIGS. 1 to 5, the hub 3 is interposed between and united with the flat and round discs 2.

The hub 3 consists of an external cylinder 4, an internal cylinder 5 and a tie plate 6. This plate 6 is located at a middle height (in the drawings) of the hub so as to firmly connect the external cylinder 4 to the internal one 5. An axial bore 7 extends through and axially of the internal cylinder. The hub 3 has six hooks 8 and two resilient pawls 9 respectively accompanied by a stopper 9A cooperating therewith for each disc in this embodiment. The hooks 8 L-shaped in side elevation protrude upwardly and downwardly (in the drawings) from opposite open ends of the hub.

Each hook 8 facing one disc and the corresponding other hook 8 facing the other disc are integral with a rib that in turn is integral with the inner periphery of the external cylinder 4. In such a pair of the hooks 8, their hooking heads are bent in opposite directions so that they assume a Z-shape as a whole. All the hooking heads on each disc 2 are bent in the same circular direction. Each resilient pawl 9 has a radial rockable body 9*a* integral therewith and continuing to an upright extension 9*b*. This extension 9*b* extending from the tie plate's 6 portion near the internal cylinder 5 extends axially thereof and is bent radially at a right angle at its upper or lower end to form the rockable body 9*a*, which extends to a proximity of the inner periphery of the external cylinder 4. The locking end of the resilient pawl 9 is a small lug that is formed on an outer end of the rockable body and protrudes axially a slight distance from the open end of the external cylinder 4. Therefore, the resilient pawl 9 in this embodiment can rock in the axial direction of the hub 3. As will be best seen in FIG. 5, the two resilient pawls 9 are located at one side of hub 3 in a diagonal relationship, and two more resilient pawls 9 are also diagonally disposed at the other side of the hub, respectively at positions close to those where the first mentioned two pawls are disposed. Each stopper 9A is disposed close to the corresponding resilient pawl 9 to be in the same positional relationship with same as that which is present between the hooking heads and their bodies 8. A rib-shaped lug protruding radially from the inner periphery of the external cylinder 4 has an end that protrudes outwardly from the open end of the hub 3, this end of the lug being the stopper referred to above.

Figure 4:
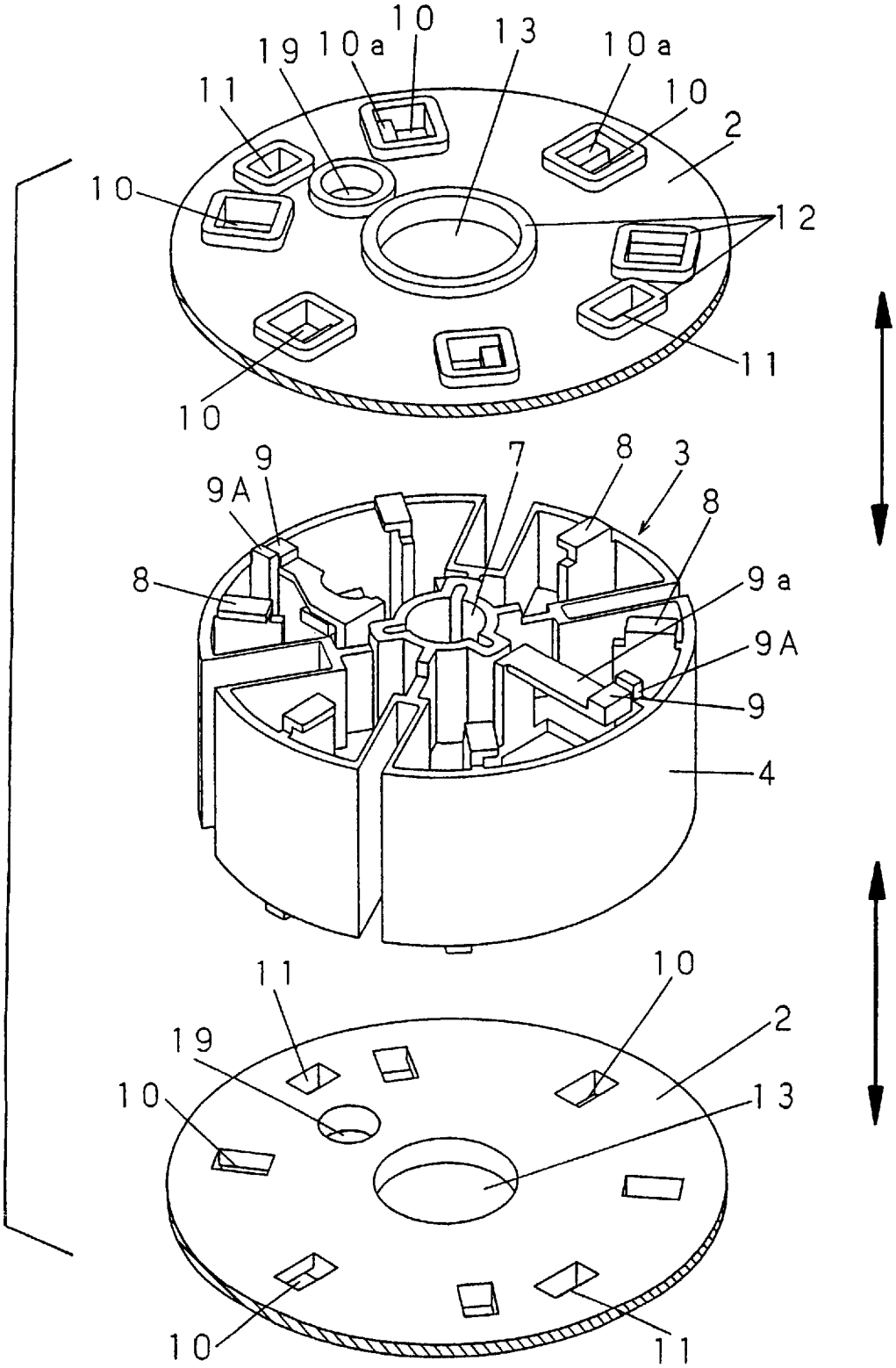
FIG. 4 is an enlarged perspective view of the first embodiment, with some parts being shown fragmentarily.
Figure 5:
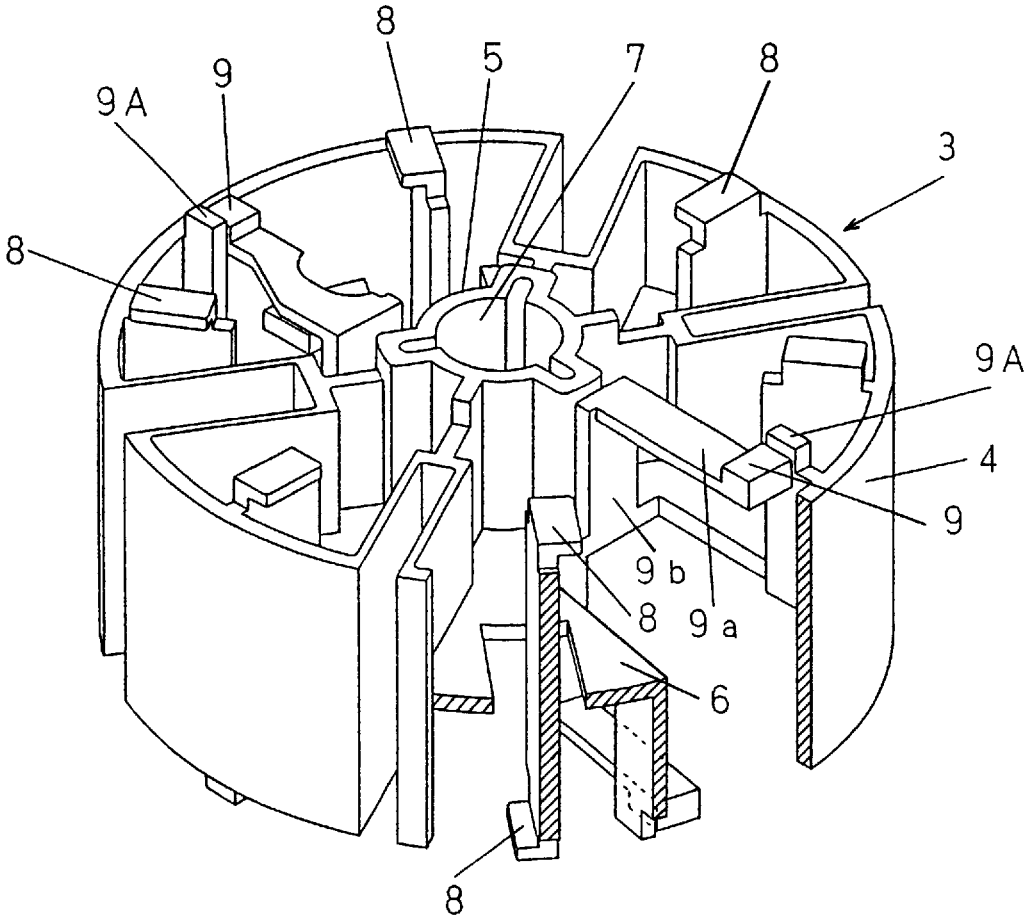
FIG. 5 is a perspective view of the hub in the first embodiment and shown on a further enlarged scale.

Each disc 2 has a central opening 13 to fit on the internal cylinder 5, as shown in FIG. 1 and shown in FIG. 4 on an enlarged scale. Six slots 10 formed in each disc and surrounding the central opening are intended to engage with the respective heads of the hooks 8. Two accessible apertures 11 also formed in each disc are intended to receive the locking ends of the resilient pawls 9 (, together with the stoppers 9A). Further, a small hole 19 as well as a plurality of windows 15 are formed in each disc. This hole 19 is for insertion of a small protrusion 21 of a manual releaser 20 as described later. A rim of the disc 2, each slot 10, each accessible aperture 11, the central opening 13 and each window 15 are respectively surrounded by ribs 12 jutting outwards. Formed inside the rib 12 surrounding each slot 10 is a shoulder 10*a* for engagement with the hooking head of each hook 8.

The size of this collapsible reel 1 depends on the length of elongate article to be wound up. Typically, the discs 2 may be 300–600 mm in diameter and 3–10 mm in thickness. The hub 3 may be 100–250 mm in diameter and 40–180 mm in width (viz., in axial length).

When assembling the reel, the hooking heads of the hooks 8 protruding up and down in FIG. 4 will be inserted in the slots 10 at first, with the stoppers 9A being also inserted in the accessible aperture 11. Subsequently, the upper one of the discs 2 will be twisted clockwise a small angle (with the lower one twisted anti-clockwise). Thus, a free edge of each hook's head 8 will be brought into engagement with the shoulder 10*a* which adjoins to the slot 10 and is located behind it in the direction of rotation of the disc being fastened to the hub.

Figure 3:
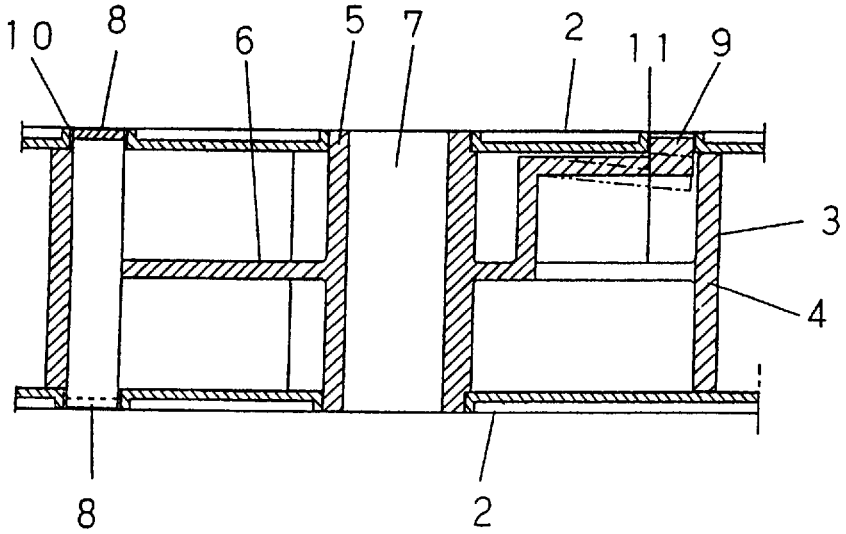
FIG. 3 is an enlarged cross section taken along the line A—A in FIG. 2.

Simultaneously with such a hooking process of the hooks 8 engaging with the slots 10, the resilient pawls 9 will be urged inwards by the disc's 2 inner face to be elastically deformed temporarily and axially of the hub, as the broken lines indicate in FIG. 3. With the disc 2 being subsequently twisted clockwise, the pawl's locking end 9 will be freed from the forced contact with the disc's inner face and snap in the accessible aperture 11 so that the disc can not rotate relative to the hub. In this state, the discs 2 are inhibited from making a further angular displacement relative to the hub 3, because the locking end of the pawl 9 pressed by a rear wall of the aperture 11 in a reverse direction will immediately bear against the stopper 9A.

Figure 2:
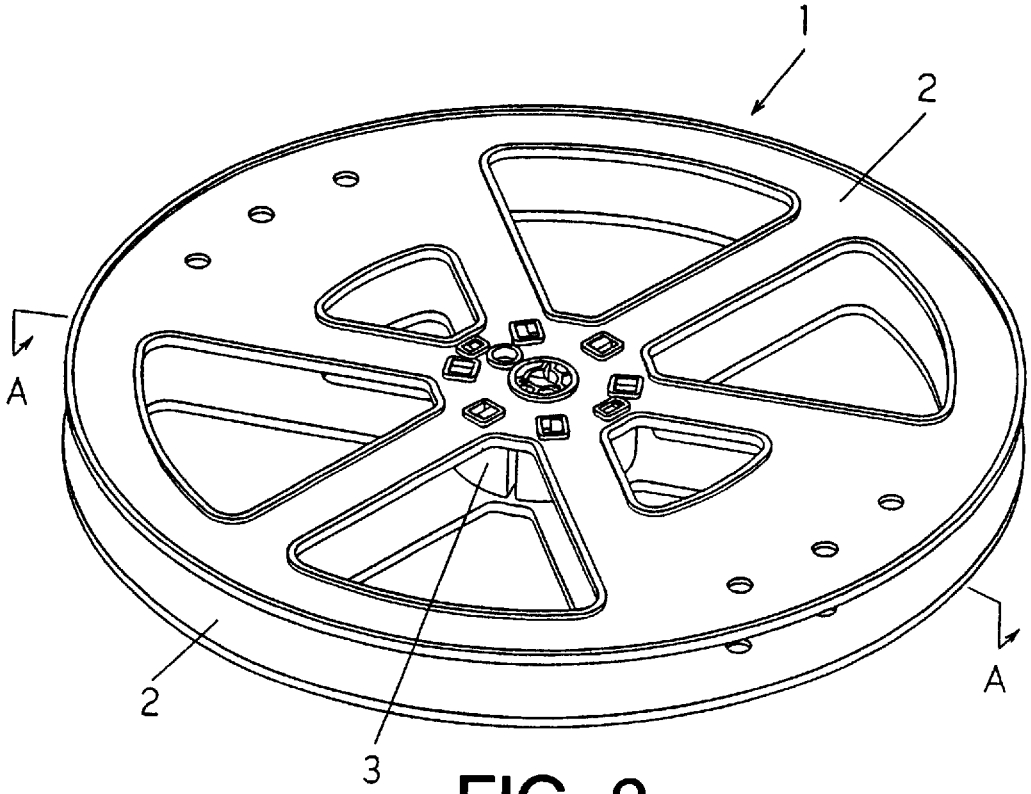
FIG. 2 is a perspective view of the reel shown in its assembled state.

In addition to this effect of the resilient pawls 9 themselves and the stoppers 9A cooperating with same to hinder the hub 3 and discs 2 from rotating relative to each other, the hooks 8 will protect the discs from any translational motion away from the hub in an axial direction thereof. The assembled reel 1 being in such a stable state is shown in FIG. 2.

Figure 6:
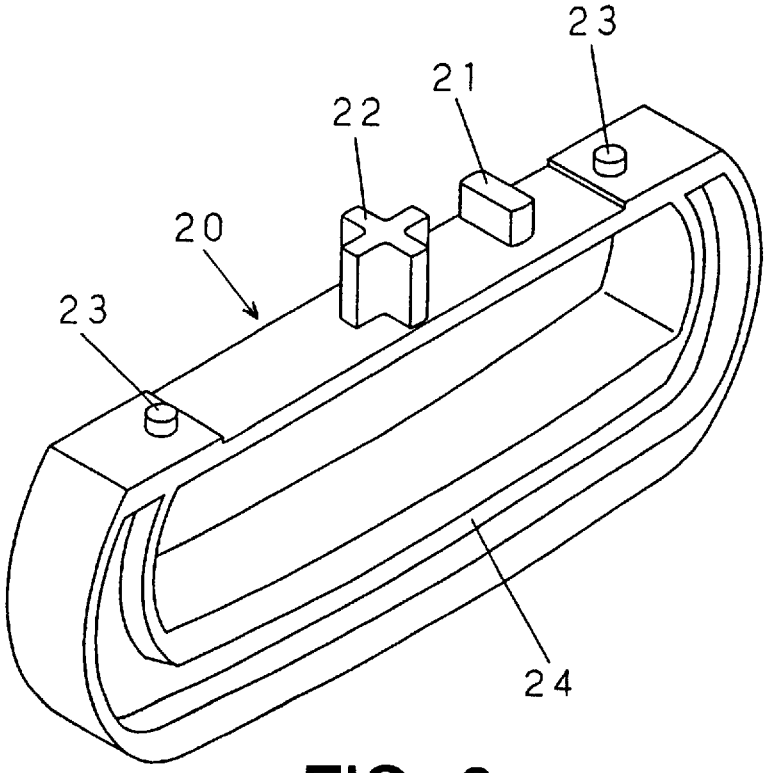
FIG. 6 is a perspective view of a manual releaser used to disconnect the discs from the hub.

The manual releaser 20 shown in FIG. 6 may be used to disassemble the reel 1 when it is not reused at the same site. An operator may grip the releaser at its handle 24 to bring it into a position such that its small protrusion 21 fits in the small hole 19 of the disc 2, and such that the middle lug 22 of the releaser fits in the axial bore 7 of the internal cylinder. Then, projections 23 of the releaser will be forced into the accessible apertures 11 so that the locking ends of the resilient pawls 9 are retracted inwardly of the disc 2 and disengaged from the apertures. With the releaser 20 being kept in this state, the operator may rotate it anti-clockwise (in FIG. 4) to disengage the hooks 8 from the respective slots 10 and separate the disc 2 from the hub. If such a manual releaser is not available, any pointed tools such as drivers may be inserted in the apertures 11 in order to remove the discs from the core in the same manner as described just above.

Since the ribs 12 are formed around each disc 2 and around each hole, each aperture and each window 15 thereof, the outer end surfaces of hooks' heads 8 will not protrude beyond a plane in which the annular rib 12 is included. Therefore, the assembled reels 1 can be stacked snugly one on another.

Each reel 1 assembled in the described manner is ready for an elongate article to be wound up on the hub 3. If the reel does not match the elongate article, any of previously prepared discs of different diameters may be combined with any of also previously prepared hubs of different widths. The reel from which the article has been unwound completely will be disassembled into sections, in the manner described above referring to FIG. 7*e*. The reels thus collapsed can be packed compact for return to a winding site.

Figure 7:
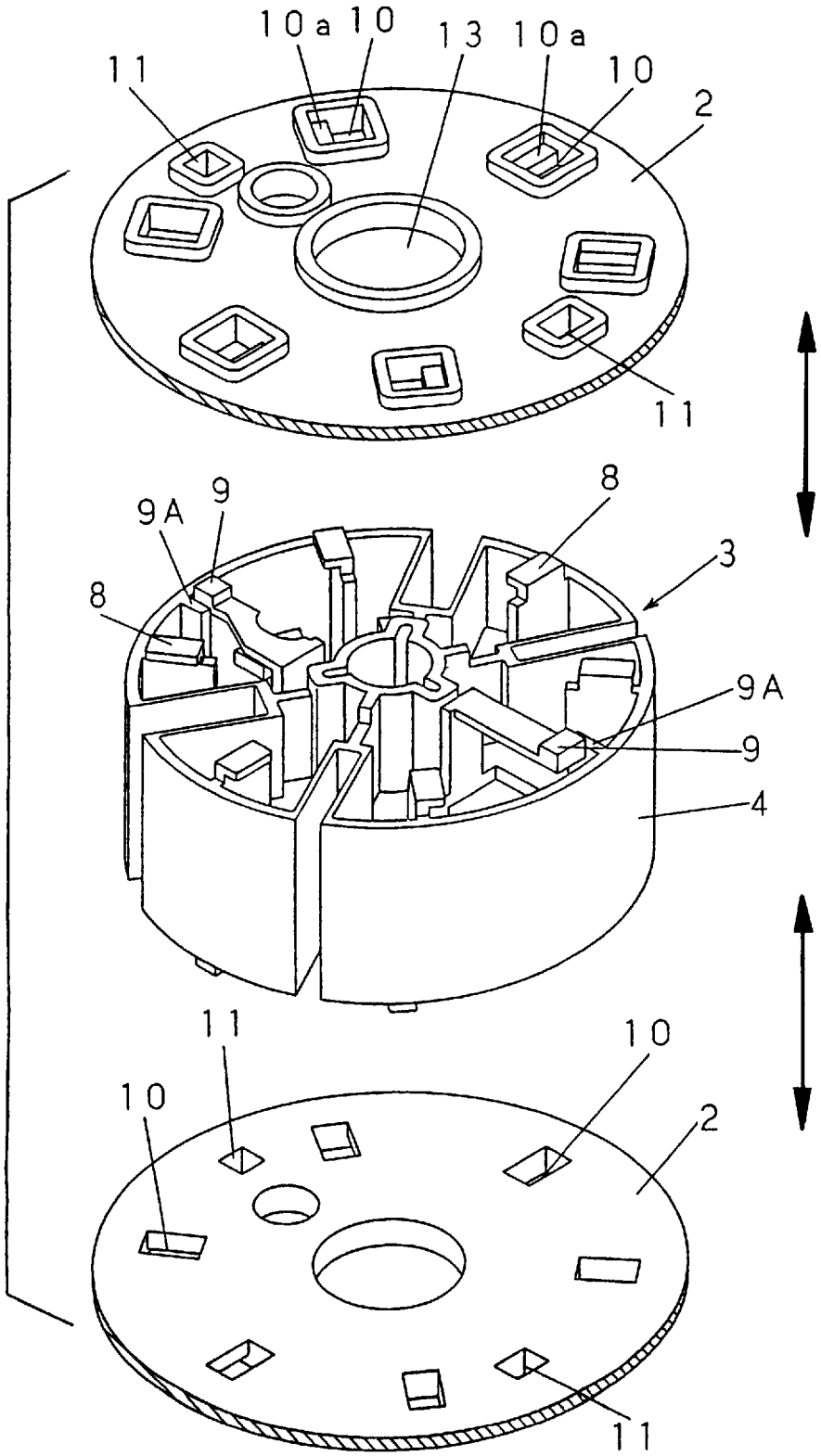
FIG. 7 is a perspective view of another reel provided in a second embodiment, and shown in a manner corresponding to FIG. 4.

A second embodiment shown in FIG. 7 differs from the first embodiment only in that only each resilient pawl 9 is engageable with one of the accessible apertures 11. In detail, the resilient pawls 9 protrude outwardly from the open end of the hub 3, with outer ends of the stoppers 9A disposed adjacent to the pawls being included in a plane of the open end of said hub. Thus, each stopper 9A is capable of bearing against the corresponding pawl 9 at its inner body portion located behind its locking end. Therefore, the accessible apertures 11 are of a size sufficient to receive only the locking ends of resilient pawls 9. The second embodiment is the same as the first one in all the other structures, and accordingly description thereof being not repeated.

Figure 8:
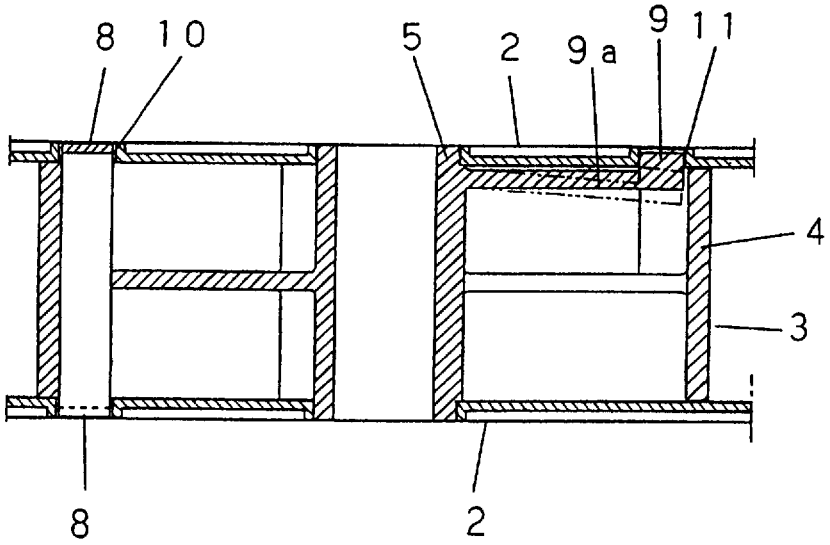
FIG. 8 is a cross section of a hub included in a further reel which a third embodiment provides.

In a third embodiment shown in FIG. 8, the radial rockable bodies 9*a* in the first embodiment are here directly connected to the outer periphery of the external cylinder 5 and integral therewith.

Figure 9:
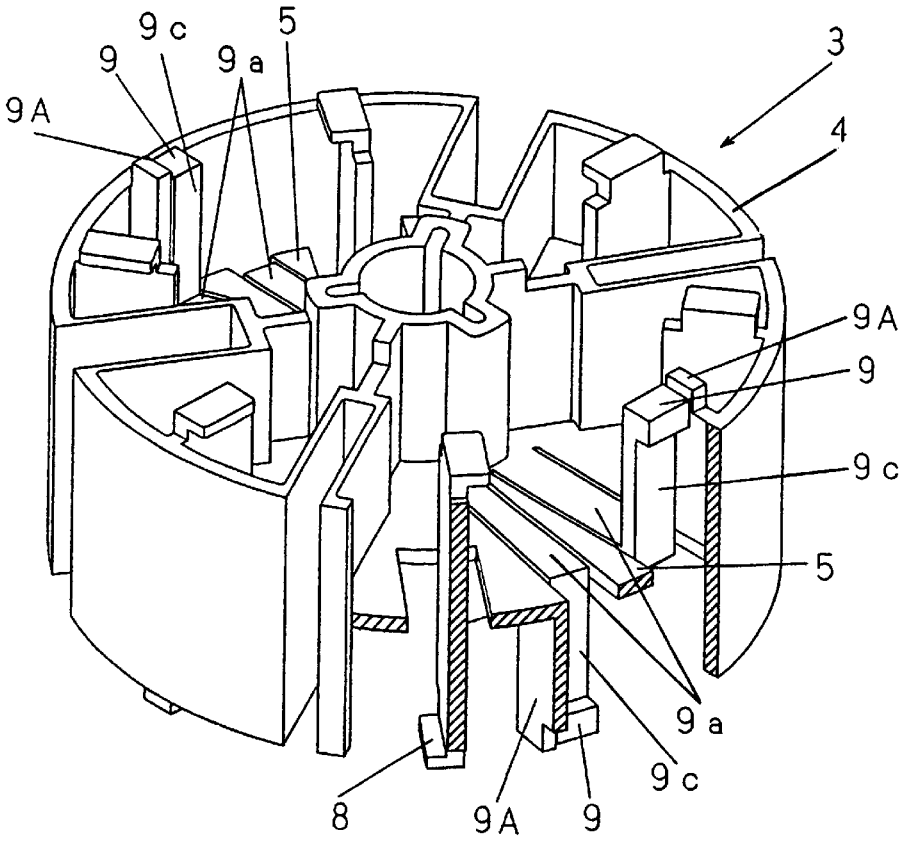
FIG. 9 is an enlarged perspective view of a hub included in a reel which a fourth embodiment provides, with some parts being shown fragmentarily.
Figure 10:
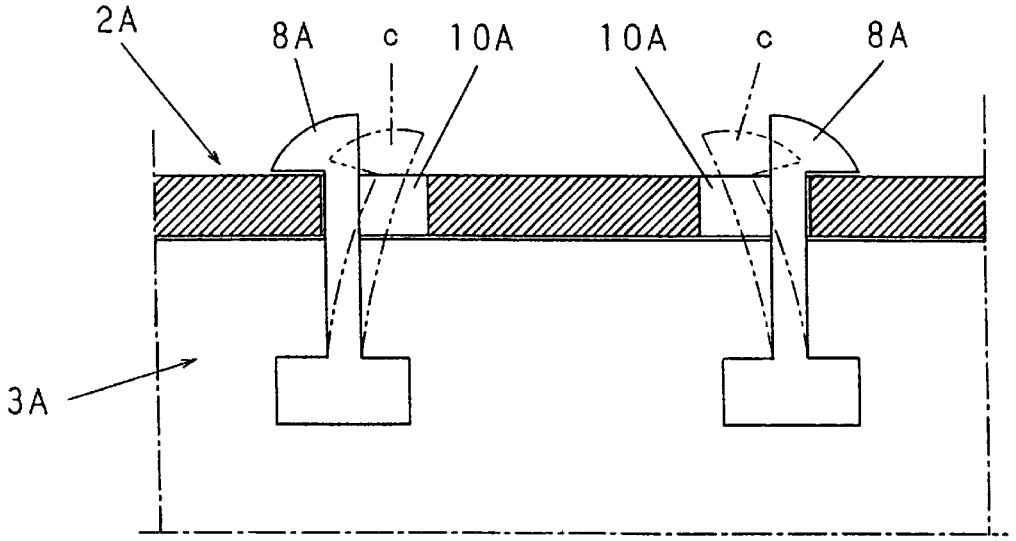
FIG. 10 PRIOR ART
FIG. 10 is a fragmentary and cross-sectional view of a prior art reel.

In a fourth embodiment shown in FIG. 9, the rockable bodies 9*a* do not extend radially but axially of the hub 3. The rockable body 9*a* in the first embodiment is replaced here with a rockable body 9*c* that extends axially of the hub 3. This rockable body 9*c* also defining at its free end the locking end and extending near and along the inner periphery of external cylinder of the hub 3 is connected to the internal cylinder by and through an extension 9*a*. This extension in the fourth embodiment is however formed as a part of the tie plate 6, with the part being separated except for its inner extremity from the remainder of the tie plate.

It will be understood that only one pawl 9 in addition to two hooks 8 suffice well for each side of the disc in order to temporarily secure same on the hub.

The foregoing embodiments may be modified in any manner insofar as the functions of the parts as well as the effects of the overall structure are ensured to achieve the objects also set forth above.

In summary, two discs and one hub all prepared separately can now be united by the connecting mechanism to form a durable and stable reel that can be readily disassembled on demand. The hooks as the members formed in the hub to constitute said mechanism have their heads protruding a small distance sideways from the ends of hub, and at least one resilient pawl also formed in the hub to serve as the other connecting member is capable of rocking in an axial direction with respect to the hub. The mechanism further comprises at least one stopper that is disposed adjacent to the resilient pawl and inhibits same from rocking in a circular direction. Those hooks engaging with the slots formed in the discs are effective to protect the discs from a high outward pressure which the elongate article wound up on the hub will impart to said discs. On the other hand, the pawls come into engagement with the apertures formed in the discs when the hooks engage with the slots. The stoppers will inhibit the pawls in this state from unintentionally moving in a circular direction in which the hooks would disengage from the slots. The hooks and the pawls cooperating with the stoppers play their own roles different in nature so that the discs can withstand well the outward pressure caused by the article wound up on this reel, and also the discs are surely retained in position relative to the hub to stabilize the assembled state of the reel.

Any undesired force that may be applied to and urge the discs towards their released position will neither impart compression stress nor tension to the bodies of the resilient pawls. Therefore, the repeated assembling and disassembling of each reel will scarcely cause the material thereof to fatigue, thus remarkably improving the durability thereof.

This collapsible reel can readily be modified in its distance between the discs and in its effective diameter, by selecting discs of a desired diameter and combining them with a hub of an appropriate diameter and proper width. Molds used to form the discs having the slots and apertures and to form the hub having the hooks, pawls and stoppers may be so simple in structure that the reels of the present invention can be manufactured easily and efficiently.

What is claimed is:

1. A reel for transporting elongate articles, the reel comprising:

a pair of discs facing one another;

a hub having opposite open ends and interposed between the discs to connect them one to another;

the hub composed of an internal cylinder and an external cylinder surrounding the internal cylinder and extending coaxially therewith;

hooks L-shaped in side elevation at their hooking heads and respectively having bodies continuing therefrom and secured to an inner periphery of the hub;

the hooking heads extending beyond the open ends of the hub so as to protrude outwardly from an outer face of each disc;

at least one resilient pawl secured in the hub and provided for each disc;

the resilient pawl having a locking end located near and inside the external cylinder at one of the open ends of the hub so as to rock axially thereof;

the resilient pawl further having a rockable body that in turn has an end formed integral with the locking end and another end connected fixedly to the internal cylinder of the hub;

at least one stopper formed integral with an inner peripheral portion of the external cylinder and located adjacent to the locking end so as to protect this locking end from rocking in a reverse circular direction;

slots formed in each disc and capable of receiving, firmly engaging with and disengaging from the respective hooking heads;

and at least one aperture also formed in each disc and capable of engaging with and disengaging from the locking end of the resilient pawl.

2. A reel as defined in claim 1, wherein the internal cylinder is connected by a tie plate to the external cylinder and extends coaxially with the external cylinder to constitute the hub, and the hub and the discs are each a molded synthetic resin piece.

* * * * *

UNITED STATES PATENT AND TRADEMARK OFFICE

CERTIFICATE OF CORRECTION

PATENT NO. : 5,803,401

DATED : September 8, 1998

INVENTOR(S) : Noriho MATSUZOE

It is certified that error appears in the above-indentified patent and that said Letters Patent is hereby corrected as shown below: On the title page, item [73] should read Assignee: Gold Industries Co., Ltd., Osaka, Japan Signed and Sealed this Thirteenth Day of July, 1999

*Attest:*

*Attesting Officer*

Q. TODD DICKINSON

*Acting Commissioner of Patents and Trademarks*